US007441857B2

(12) United States Patent
Murase

(10) Patent No.: US 7,441,857 B2
(45) Date of Patent: Oct. 28, 2008

(54) IMAGE FORMING APPARATUS

(75) Inventor: Tetsuya Murase, Chiba (JP)

(73) Assignee: Seiko I Infotech Inc. (JP)

( * ) Notice: Subject to any disclaimer, the term of this patent is extended or adjusted under 35 U.S.C. 154(b) by 85 days.

(21) Appl. No.: 10/588,928

(22) PCT Filed: Feb. 8, 2005

(86) PCT No.: PCT/JP2005/001853

§ 371 (c)(1),
(2), (4) Date: Oct. 13, 2006

(87) PCT Pub. No.: WO2005/077661

PCT Pub. Date: Aug. 25, 2005

(65) Prior Publication Data

US 2008/0023908 A1 Jan. 31, 2008

(30) Foreign Application Priority Data

Feb. 18, 2004 (JP) ..... 2004-041494

(51) Int. Cl.

| | |
|---|---|
| ***B41J 2/01*** | (2006.01) |
| ***B41J 29/38*** | (2006.01) |
| ***B65H 5/00*** | (2006.01) |
| ***B65H 29/44*** | (2006.01) |

(52) U.S. Cl. ..... 347/16; 347/104; 347/105; 347/101; 271/181; 271/225

(58) Field of Classification Search ..... 347/16, 347/101, 104–105; 271/181, 225
See application file for complete search history.

(56) References Cited

U.S. PATENT DOCUMENTS 4,269,522 A * 5/1981 Levinson et al. ..... 400/616.1
2002/0140800 A1* 10/2002 Saito et al. ..... 347/222

* cited by examiner

*Primary Examiner*—Julian D. Huffman
*Assistant Examiner*—Jason S Uhlenhake
(74) *Attorney, Agent, or Firm*—Adams & Wilks

(57) ABSTRACT

An image forming apparatus that can perform stable sheet conveying for a medium that has low tear-resistance, easily sticks to something and is difficult to convey. Therefore, sheet conveying means is controlled, so that during a sheet conveying operation for each path, after a sheet has been conveyed, reverse feeding is performed to release sticking, and sheet feeding is thereafter completed.

2 Claims, 4 Drawing Sheets

IMAGE FORMING APPARATUS

TECHNICAL FIELD

The present invention relates to an image forming apparatus that forms an image on a sheet that is fed, and relates in particular to an image forming apparatus that forms an image on a sheet while drawing down the sheet through suction in order to prevent the raising of the sheet.

BACKGROUND ART

As such image forming apparatuses, printers employing inkjet recording systems, plotter, etc., are known. During printing, a conventional inkjet image forming apparatus conveys a sheet a predetermined distance. Then, a print head is moved in a direction perpendicular to a sheet conveying direction (carriage drive), and ink droplets are discharged from the print head to perform image forming. In order to prevent the raising of the sheet and to stabilize printing quality during sheet conveying and during carriage driving, generally, a plurality of suction holes are formed in a platen arranged on a face opposite a print head, and printing is performed while the sheet is drawn down by suction. This sheet conveying and carriage driving is repeated a required number of times, and image forming is completed (see, for example, Japanese Patent Laid-Open Publication No. 2003-326779 (pp. 3 to 6)).

In an image forming apparatus (inkjet recording apparatus) employing the above described inkjet recording system, sheets to be conveyed are limited, and the setting of a suction force relative to the tear-resistance of a sheet or for preventing the raising of the sheet is important. Especially for an image forming apparatus that discharges solvent ink to perform printing, a medium such as vinyl chloride resin film or tarpaulin paper is employed as a sheet. Such media tend to have low tear-resistance and to be easily folded. Further, as a feature of such materials, these media tend to easily stick to paper guides or to platens.

When these media are employed, a sheet that is conveyed is adversely affected by the force of the suction used to prevent raising, and correct conveying of the sheet across the platen is disabled. In portions other than near the conveying rollers, the sheet remains stuck to the platen or the paper guide, so that the sheet is conveyed only near the conveying rollers. As a result, the sheet is raised at the platen and is folded, and the carriage and the sheet contact each other and cause a jam, which may destroy the head.

In addition, in the solvent inkjet recording apparatus, frequently, a sheet heater is provided for the platen or the paper guide and heats the sheet in order to dry the output material after the printing has been completed. In this case, the sheet heated by the heater tends to become softer and to lose tear-resistance, so that sheet conveying is more difficult.

Therefore, one objective of the present invention is to provide an image forming apparatus that enables stable sheet conveying of a medium that has low tear-resistance, tends to stick to something and is difficult to convey.

DISCLOSURE OF THE INVENTION

To achieve the above objective, an image forming apparatus according to the present invention, which comprises: conveying means, for conveying a sheet; sheet suction means, for holding a sheet on a platen through suction; a print head for, based on image data, moving in a direction perpendicular to a sheet conveying direction and performing printing on the sheet; and control means, for controlling the conveying means and which alternately repeats, for each path, a sheet conveying operation and a printing operation a required number of times to form an image on the sheet, is characterized in that:

when the sheet is to be conveyed in a specific direction a predetermined feeding distance (Lx) during the conveying operation for each path, the control means permits the conveying means to first convey the sheet a predetermined distance (L1) in the specific direction (+X direction), then to convey the sheet a direction (−X), the opposite of the specific direction (+X), a distance (L: L=L1+ΔL1) that is obtained by adding a short distance (ΔL1) to the predetermined distance (L1), and to further convey the sheet in the specific direction (+X) a distance (Lx+ΔL1).

BEST MODE FOR CARRYING OUT THE INVENTION

Figure 1:
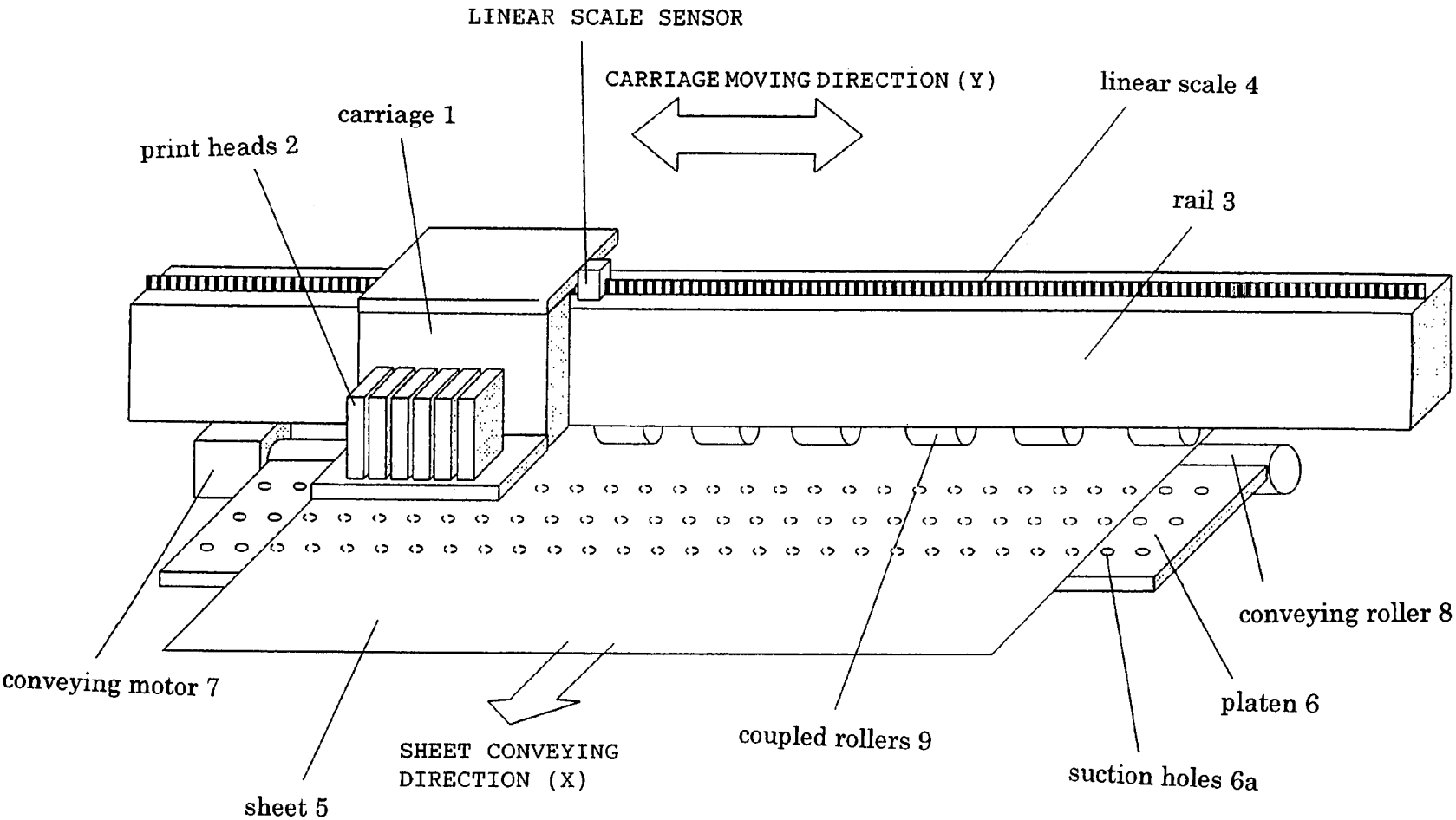
FIG. 1 is an outline diagram showing the structure (related to carriage moving and sheet conveying) of an inkjet printer according to the present invention.

The best mode for carrying out the present invention will now be explained while referring to the drawings.

Figure 2:
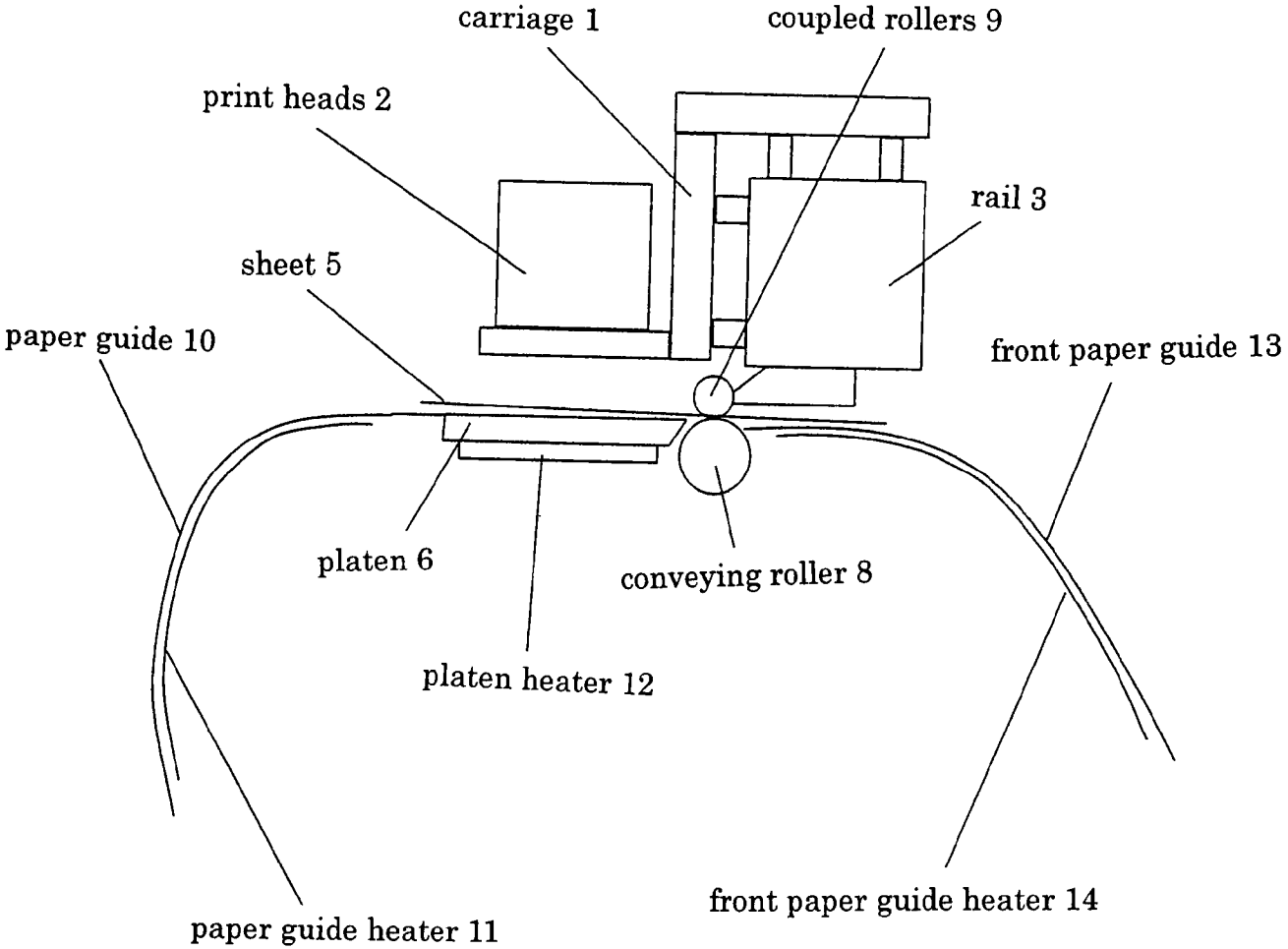
FIG. 2 is a structure diagram showing the structure (related to carriage moving and sheet conveying) of an inkjet printer according to the present invention.

FIG. 1 is an outline diagram showing the structure (related to carriage moving and sheet conveying) of an inkjet printer that is an example image forming apparatus according to the present invention. FIG. 2 is a structure diagram showing the structure of the inkjet printer in FIG. 1, viewed in the transverse direction. In FIG. 1, a carriage 1, in which a plurality of print heads 2 are mounted, reciprocally moves in a carriage moving direction (Y), along a carriage support rail 3, as a belt (not shown) is driven by a carriage motor (not shown). The plurality of print heads 2 correspond to black (K), cyan (C), magenta (M), yellow (Y), light magenta (Lm) and light cyan (Lc) inks. A linear scale 4 provided along the carriage support rail 3 provides a reference for determining the position of the carriage 1 in the main scanning direction (carriage moving direction (Y)), and functions together with a linear scale sensor provided for the carriage 1. When a regular stripe pattern or a slit in the linear scale is detected by the linear scale sensor, the current position of the carriage 1 (or the print head 2) is identified. For recognition of the head position, not only is use made of the linear scale, but also, monitoring of the drive pulses of a rotary encoder or a carriage motor can be employed.

By driving a conveying motor 7, a sheet (print medium) 5, on which printing is to be performed by the print heads 2, is conveyed across a platen 6 by a conveying roller 8 and a plurality of coupled rollers 9 in a sheet conveying direction (X) substantially perpendicular to the carriage moving direction (Y). For sheet conveying, a rotary encoder (not shown), which is attached to the conveying motor 7, and a controller (not shown), which controls the rotary encoder, detect a count held by the rotary encoder, and rotate the conveying motor 7 in the sheet feeding direction a predetermined count. Then, the conveying roller 8 can be rotated, and the sheet can be conveyed a predetermined distance. Further, the conveying motor 7 can also be rotated in a reverse feeding direction (−X) that is the opposite of the conveying direction (X). Normally, in consonance with the printing mode, sheet conveying a predetermined distance (Lx) is performed.

When the sheet 5 has been conveyed and the printing operation is initiated, the carriage 1 is moved along the rail 3 by a carriage drive motor (not shown), ink droplets are discharged by the print heads 2 in accordance with image data, and an image is formed on the sheet.

This sheet conveying operation and the printing operation performed by moving the carriage are together called a path, and when this path has been repeated a required number of times, image forming is completed.

Further, a plurality of suction holes 6*a* for applying suction to a sheet are formed in the platen 6. By using a suction fan (not shown), provided for externally discharging air from the lower portion of the platen 6, a negative pressure is maintained inside the platen during the printing operation and the sheet feeding operation. Thus, during the sheet conveying operation and the printing operation, the sheet 5 is held on the platen 6 by suction.

The printing operation will now be explained. When a sheet is set and printing is initiated, first, the printing operation is performed by moving the carriage, and printing on the sheet 5 is conducted. As a step thereafter, the sheet conveying operation is performed. While actually printing and moving the carriage, sheet conveying is not performed, and while a sheet is actually being conveyed, printing and moving the carriage is not performed. The printing operation and the sheet feeding operation are together called a path. This path is repeated a required number of times, in accordance with image data and a printing mode such as normal-density printing or high-density printing, and the final image is completed. The final sheet conveying distance in the sheet conveying operation for each path, i.e., a predetermined sheet feeding distance (Lx) for each path, is fixed.

Figure 3:
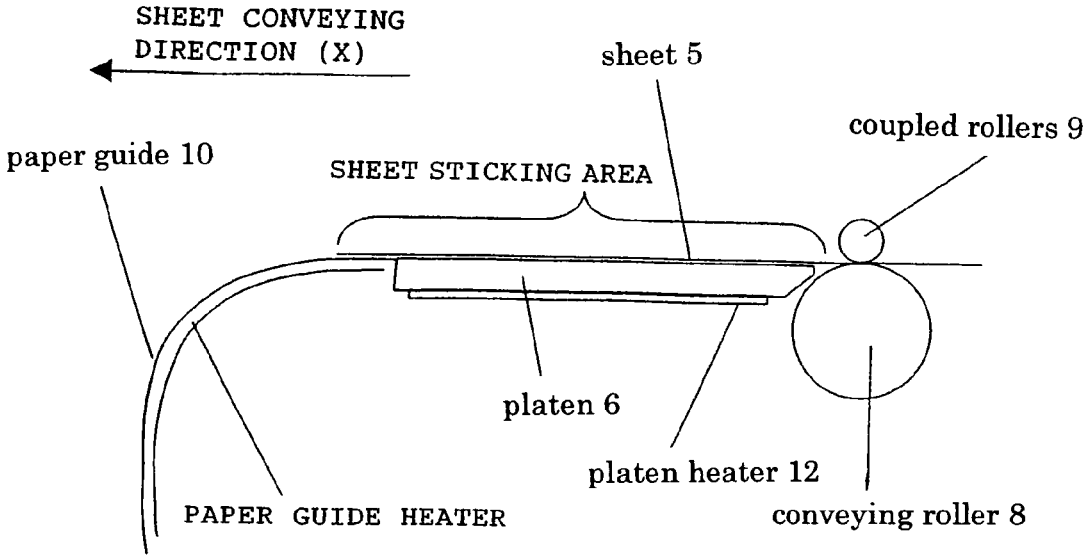
FIG. 3 is an explanatory diagram for explaining the state wherein a sheet is stuck.

When printing is to be performed for low tear-resistance media or easily stuck media, within a short time for the printing operation, performed by moving the carriage, the sheet 5 tends to stick to the platen or the paper guide due to a temperature/humid environment during printing, or due to a setting for a sheet drying heater. In FIG. 3 is shown a state in which, during the previous printing operation, the sheet 5 stuck to the platen 6 and to the paper guide 10.

This sheet conveying operation will now be explained in detail. First, by driving the conveying motor 7, the sheet 5 is conveyed only a predetermined distance (L1) in the sheet conveying direction (+X). In this case, L1 has the relationship Lx≧L1. For convenience sake, this is called conveying A for each path.

Figure 4:
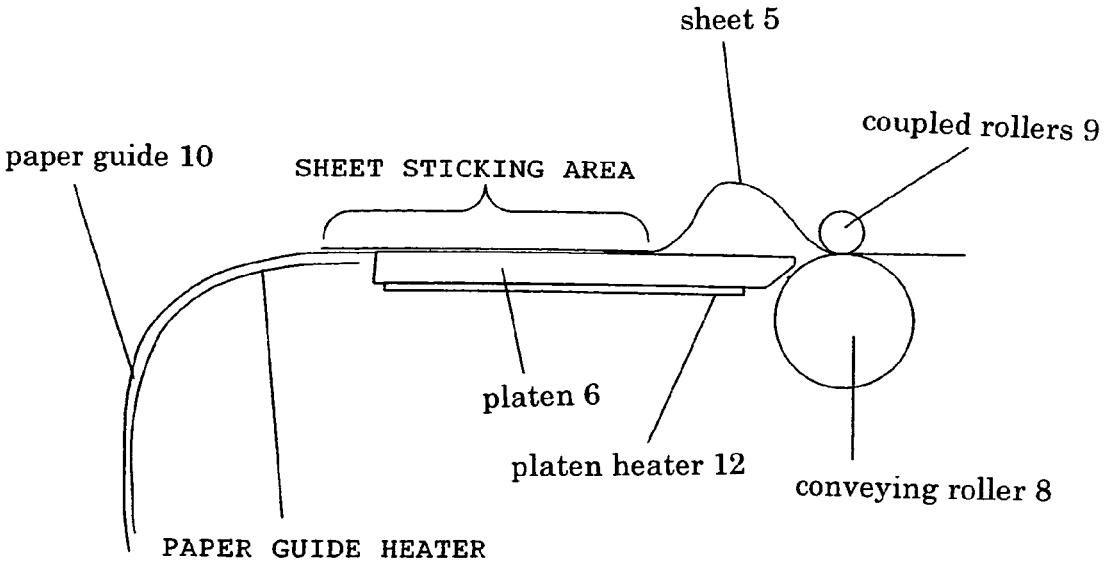
FIG. 4 is an explanatory diagram for explaining the state wherein a sheet is raised because the sheet has become stuck during sheet conveying.

The sheet 5 is stuck either to the platen 6 or to a paper guide 10; however, since the force with which the sheet 5 is stuck to the platen 6 or the paper guide 10 is not as strong as the force exerted by the conveying roller 8 and the coupled rollers 9 for feeding the sheet, at the time of conveying, the conveying roller 8 and the coupled rollers 9 do not slip while against the sheet 5. Therefore, the sheet 5 is conveyed the predetermined distance (L1) near the conveying roller 8 and the coupled rollers 9. However, at a portion other than that near the conveying roller 8 and the coupled rollers 9, the sheet 5 is stuck to either the platen 6 or the paper guide 10, or is stuck to both of them, and the sheet 5 is not normally conveyed and is deflected above the platen 6 or the paper guide 10, as shown in FIG. 4, and is gently raised. In this state, the sheet 5 is not normally conveyed; however, when the sheet is raised, air enters the space in the vicinity of the area whereat the sheet 5 is stuck to the platen 6 or the paper guide 10, so that an effect that permits the easy peeling off of the sheet can be obtained.

Figure 5:
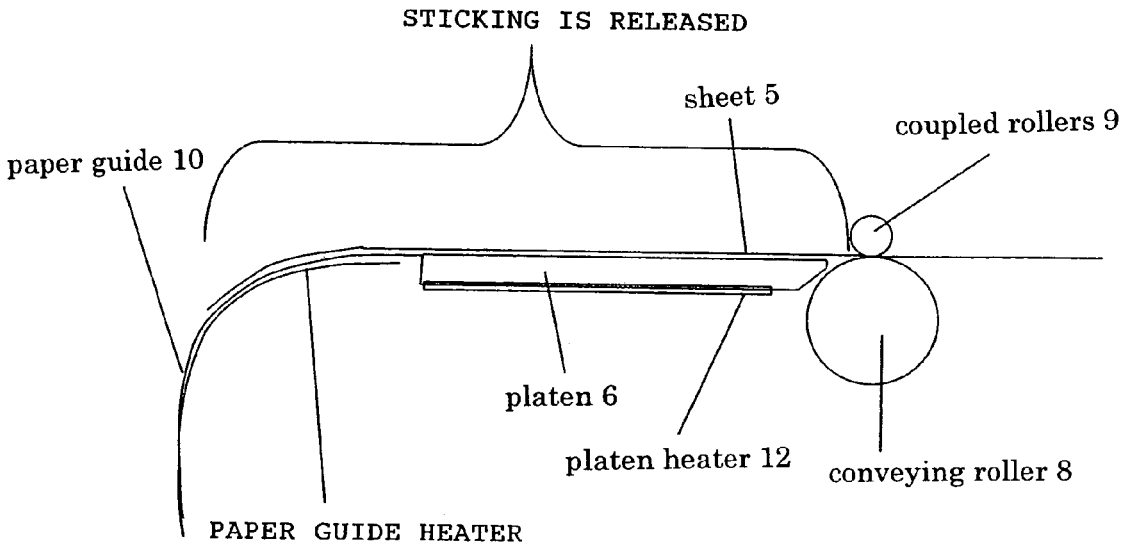
FIG. 5 is an explanatory diagram for explaining the state wherein a sheet stuck during sheet conveying is released.

Then, in this state, sheet reverse feeding is performed. That is, the sheet 5 is conveyed in a reverse feeding direction (−X), opposite that of the sheet conveying direction (+X), a distance (L2: L2=L1+ΔL1) that is obtained by adding a short distance (ΔL1) to the predetermined distance (L1). When the sheet 5 is reversely fed the distance L1, the deflection on the platen 6 disappears and the sheet 5 is stretched. Sequentially, when the sheet is reversely conveyed an extra distance ΔL, a collision (repulsive force) occurs between the sheet 5 and the platen 6 or the paper guide 10. Through the collision (repulsive force), the sticking of the sheet 5 to the platen 6 or to the paper guide 10 is released, and the sheet 5 is peeled off. In the state in FIG. 5, the sticking of the sheet 5 to the platen 6 or to the paper guide 10 has been eliminated, and the sheet 5 can be smoothly conveyed across the platen 6 or along the paper guide 10. It should be noted that ΔL1 has the relationship. 0<ΔL1<L. For convenience sake, this is also called conveying B.

Finally, sheet conveying a distance (Lx+ΔL1) is performed in the sheet conveying direction (+X), and the sheet is conveyed to a predetermined position, moved forward the distance Lx when compared with the previous printing (the previous path). This is called conveying C. As described above, since conveying A to conveying C are sequentially performed, the sticking of the sheet 5 to the platen 6 or to the paper guide 10 is released, and the sticking is eliminated. Thus, normal sheet conveying is enabled.

It should be noted that, in accordance with an experiment, relationships L1=Lx×(0.5 to 1) and ΔL1=L1×(0.05 to 0.3) were found to be especially effective for increasing the ease with which peeling off is performed and for providing sheet feeding accuracy.

In the above description, an example has been employed wherein one peeling-off operation, which is conveying B, is performed for one path. However, as an example, in a case wherein the sheet 5 sticks very much, or a case wherein the stuck area is wide, the peeling-off operation need only be performed multiple times for the stuck sheet to be released.

An example for the performance of the peeling-off operation twice will now be explained. In the sheet conveying operation for each path, first, by driving the conveying motor 7, the sheet 5 is conveyed only a predetermined distance (L1) in the sheet conveying direction (+X). In this case, L1 also has the relationship Lx≧L1. This is called conveying A'. At this time, since the sheet 5 is stuck in the manner described above, the sheet 5 is not normally conveyed, and instead, is deflected above the platen 6 or the paper guide 10 and is gently raised.

Following this, sheet reverse feeding is performed. That is, the sheet 5 is conveyed in the reverse feeding direction (−X), opposite the sheet conveying direction (+X), a distance (L2: L2=L1+ΔL1), which is obtained by adding a short distance (ΔL1) to the predetermined distance (L1), and the sticking is released. In this case, when the sheet 5 is reversely fed the distance L1, deflection on the platen 6 also disappears, and the sheet is well stretched. Furthermore, when the sheet is sequentially reversely fed an extra distance ΔL, a collision (repulsive force) occurs between the sheet 5 and the platen 6 or the paper guide 10. Through this collision (repulsive force), the sticking of the sheet 5 to the platen 6 or to the paper guide 10 is released, and the sheet 5 is peeled off. It should be noted that ΔL1 has the relationship 0<ΔL1<L1. For convenience sake, this is also called conveying B'.

Next, the sheet conveying A' operation is performed again. At this time, the sticking of the sheet 5 has been released to a degree by the first sheet conveying B' operation; however, there is a case wherein the sticking has still not yet been released for the portion downstream of the conveying roller. In this case, the sheet is not normally conveyed, and is deflected above the platen 6 or the paper guide 10 and is gently raised. Thus, the conveying B' operation is performed again to release the sticking of the sheet.

Thereafter, sheet conveying a distance (Lx+2×ΔL1) is performed in the sheet conveying direction (+X), and the sheet is conveyed to a predetermined position that is moved forward the distance Lx, when compared with the previous printing (previous path). This is called conveying C'.

As described above, since these sheet conveying operations, i.e., conveying A', B', A', B' and C' are sequentially performed, the sticking of the sheet 5 to the platen 6 or the paper guide 10 can be removed more appropriately than when one peeling-off operation is performed. Therefore, more stable sheet conveying is enabled under a no sheet-sticking condition. When the conveying A (or A') and conveying B (or B') are repeated multiple (n) times, the peeling effects relative to the sticking of sheets are increased, and the stability of sheet conveying is improved. In this case, the sheet feeding distance in the conveying C (or C') can be provided as (Lx+n×ΔL1).

INDUSTRIAL APPLICABILITY

According to the present invention, for media that have low tear-resistance, tend to stick easily to something and are difficult to convey, when sheet conveying means is controlled for each path, a sticking sheet can be peeled off. Thus, stable sheet conveying can be provided.

The invention claimed is:

1. An image forming apparatus, which comprises: conveying means, for conveying a sheet; sheet suction means, for holding a sheet on a platen through suction; a print head for, based on image data, moving in a direction perpendicular to a sheet conveying direction and performing printing on the sheet; and control means, for controlling the conveying means and which alternately repeats, for each path, a sheet conveying operation and a printing operation a required number of times to form an image on the sheet, characterized in that:

when the sheet is to be conveyed in a specific direction a predetermined feeding distance (Lx) during the conveying operation for each path, the control means permits the conveying means to first convey the sheet a predetermined distance (L1) in the specific direction (+X direction), then to convey the sheet a direction (−X), the opposite of the specific direction (+X), a distance (L: L=L1+ΔL1) that is obtained by adding a short distance (ΔL1) to the predetermined distance (L1), and to further convey the sheet in the specific direction (+X) a distance (Lx+ΔL1).

2. An image forming apparatus according to claim 1, characterized in that:

the control means permits the conveying means to repeat, multiple (n) times, during the conveying operation for one path, the conveying of a sheet the predetermined distance (L1) in the specific direction (+X direction) and reverse feeding of the sheet in the direction (−X), opposite the specific direction (+X), a distance (L: L=L1+ΔL1), which is obtained by adding a short distance (ΔL1) to the predetermined distance (L1); and to finally convey the sheet in the specific direction (+X) a distance (Lx+n×ΔL1).

* * * * *